United States Patent [19]

Taniguchi

[11] Patent Number: 4,851,045

[45] Date of Patent: Jul. 25, 1989

[54] HOT-MELT INK

[75] Inventor: Makoto Taniguchi, Nagano, Japan

[73] Assignee: Seiko Epson Corporation, Tokyo, Japan

[21] Appl. No.: 88,459

[22] Filed: Aug. 24, 1987

[30] Foreign Application Priority Data

Aug. 25, 1986 [JP] Japan ..... 61-198350

[51] Int. Cl.[4] ..... B09D 11/12

[52] U.S. Cl. ..... 106/31; 106/22; 106/32; 106/272; 523/160

[58] Field of Search ..... 106/22, 23, 31, 32, 106/272; 523/160

[56] References Cited

U.S. PATENT DOCUMENTS

| | | | |
|---|---|---|---|
| 3,248,236 | 4/1966 | Raczynski et al. | 106/22 |
| 3,389,011 | 6/1968 | Svensson | 106/22 |
| 3,394,095 | 7/1968 | Treacy | 106/272 |
| 3,994,737 | 11/1976 | Bienvenu | 106/31 |
| 4,038,297 | 7/1977 | Rodenberg et al. | 106/27 |
| 4,064,149 | 12/1977 | Rieger et al. | 106/31 |
| 4,066,810 | 1/1978 | Kosaka et al. | 106/22 |
| 4,171,981 | 10/1979 | Austin et al. | 106/21 |
| 4,484,948 | 11/1984 | Merritt et al. | 106/31 |
| 4,636,258 | 1/1987 | Hayashi et al. | 106/31 |
| 4,707,395 | 11/1987 | Ueyama et al. | 106/31 |

*Primary Examiner*—Paul Lieberman
*Assistant Examiner*—Helene Kirschner
*Attorney, Agent, or Firm*—Blum Kaplan

[57] ABSTRACT

A hot-melt ink containing between about 5 and 50 parts by weight of montan wax or oxidized montan-type wax or both having a melting point between about 60° and 125° C. is provided. The ink is useful in a heat transfer sheet where it is provided as a layer on one side of a substrate and a resistive layer is provided on the substrate on the side opposite the ink. Inks prepared in accordance with the invention exhibit good superimposing performance and improved blocking resistance.

14 Claims, 8 Drawing Sheets

CYAN INK

| | A | B | C | D | E | F | G | H | I | J | K | L | M | N | O | P |
|---|---|---|---|---|---|---|---|---|---|---|---|---|---|---|---|---|
| TIME | 4/16 | 8/16 | 12/16 | 16/16 | 20/16 | 24/16 | 28/16 | 32/16 | 36/16 | 40/16 | 44/16 | 48/16 | 52/16 | 56/16 | 60/16 | 64/16 |

UNIT : (m·s)

TRANSFER ENERGY: 10(mJ/mm²)

MAGENTA INK

TIME : 4(m·s)
TRANSFER ENERGY: 10 (mJ/mm²)

HOT-MELT INK

BACKGROUND OF THE INVENTION

This invention relates to hot-melt inks and, in particular, to a hot-melt ink for use in a fusible ink sheet of the type used for thermal transfer printing.

The use of thermal transfer recording has increased in recent years and various types of hot-melt inks have been proposed. These inks must change from a solid phase to a liquid phase and back to a solid phase in the short period of time during which heat is applied in order to accomplish effective thermal transfer. Waxes are known substances that are capable of undergoing these phase changes. Therefore, heat transfer inks are commonly prepared by dispersing a coloring material such as a pigment and/or a dye such as carbon black in a natural or synthetic wax primarily containing hydrocarbons. A small amount of synthetic resin or plasticizer can also be added to improve film strength, adhesiveness, flexibility and the like.

An increasing amount of research activity has recently been directed to the problem of superimposing heat transfer inks of different colors in transfer type color printers. In general, heat transfer inks have reduced overlap efficiency. Specifically, when a cyan ink is transferred onto another ink, for example a magenta ink, the density of the cyan ink is significantly lower than the density obtained when the cyan ink is transferred directly onto plain paper. A similar reduction in transfer efficiency occurs when multicolor printing using combinations of yellow, magenta, cyan and black inks is attempted. This is the primary disadvantage of transfer type color printers designed to produce prints having intermediate color tones.

A number of attempts have been made to overcome these problems including adding tackifiers to the ink layer and lowering the ink layer melting point. These attempts are effective for improving transfer efficiency when two or more inks are used but have given rise to a number of new problems as described below.

Fusible ink sheets generally include a substrate having a hot melt ink provided on one side and an electrothermal resistive layer provided on the other side. Blocking is the undesirable adhesion that occurs between the ink layer and the substrate when the transfer sheet is wound on a roll with the layers disposed on top of each other. Since the addition of a tackifier to an ink layer naturally increases tackiness, blocking becomes more likely. For example, wax sticks to the thermal head thereby lowering thermal efficiency. In addition, if the ink adheres to the resistive layer, the resistance becomes so high that transfer is no longer possible. Blocking is particularly disadvantageous in full color printing as it becomes difficult to express a gradation of shades due to insufficient optical density of the inks or an inability to control optical density.

When low melting point inks are used, a first transferred ink is melted when a second ink of a different color is transferred onto the first ink. As a result, the second ink is mixed with the first ink in a molten state to achieve improved transfer efficiency. However, low melting point inks also lower the temperature at which blocking occurs.

It is, therefore, desirable to provide a hot-melt ink that can be transferred onto another ink as efficiently as it can be transferred onto paper and which has a high degree of blocking resistance.

SUMMARY OF THE INVENTION

Generally speaking, in accordance with the invention, a hot-melt ink containing between about 5 and 50 parts by weight of a montan wax or an oxidized montan-type wax having a melting point between about 60° and 125° is provided. The ink is useful in a heat transfer sheet wherein it is provided on a substrate and a resistive layer is provided on the substrate on the side opposite the ink. Inks prepared in accordance with the invention provide good superimposing performance and improved blocking resistance.

Accordingly, it is an object of the invention to provide a hot-melt ink that can be efficiently transferred onto another ink.

It is another object of the invention to provide a hot-melt ink that has a high degree of blocking resistance.

It is a further object of the invention to provide a hot-melt ink that can produce a full color print having excellent color balance in the full range from low to high density.

Still other objects and advantages of the invention will in part be obvious and will in part be apparent from the specification.

The invention accordingly comprises a composition of matter possessing the characteristics, properties and the relation of components which will be exemplified in the composition hereinafter described, and the scope of the invention will be indicated in the claims.

DESCRIPTION OF THE DRAWINGS

For a fuller understanding of the invention, references had to the following description, taken in connection with the accompanying drawings, in which.

DETAILED DESCRIPTION OF THE INVENTION

Figure 1A:
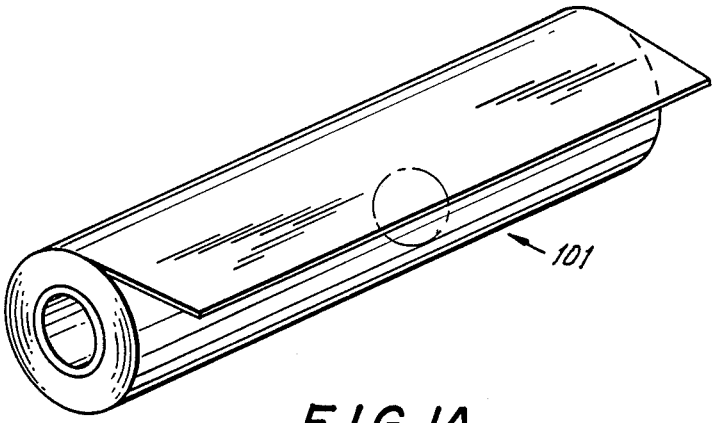
FIG. 1A is a perspective view of a roll of a conventional fusible ink sheet.

In accordance with the invention, a hot-melt ink contains between 5 and 50 parts by weight of montan wax, an oxidized montantype wax or both having a melting point between about 60° and 125° C. A dye, pigment or coloring agent is added to the wax. The ink is useful in a heat transfer sheet wherein it is provided on a substrate and a resistive layer is provided on the substrate on the side opposite the ink. The oxidized montan-type wax is preferred.

In addition to the montan wax or oxidized montan-type wax and the dye, pigment or coloring material used in accordance with the invention, the ink can also include a second wax such as carnauba wax or N-paraffin wax in an amount up to about 50% by weight, ethylene-vinyl acetate copolymer in an amount up to about 15% by weight, and effective amounts of additional components such as coloring material dispersants. The dye, pigment or coloring material can be used in an amount up to about 15% by weight.

The oxidized montan-type waxes used in the ink compositions of the invention are preferably one of the following:

(a) Acid-modified montan-type wax having the formula:

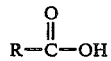

wherein R is an organic group having between about 25 and 35 carbon atoms;

(b) Ester-modified montan-type wax having the formula:

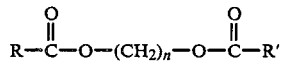

wherein R and R' are organic groups having between about 25 and 35 carbon atoms and n is an integer greater than or equal to 1; or (c) Partially saponified ester-modified montan-type wax having the formula:

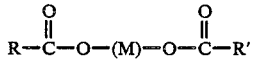

wherein R and R' are organic groups having between about 25 and 35 carbon atoms and M is an alkaline earth metal.

"Oxidized montan-type wax" is synthesized from coal and primarily includes montan wax.

Thermal transfer inks have low blocking resistance when oxidized montan-type wax having a melting point less than about 60° C. is used. When the wax has a melting point higher than about 125° C., a large amount of thermal energy is required to melt the ink. This causes the thermal head or electrical resistance type thermal transfer head to have a shortened life.

Satisfactory results are not obtained when the thermal transfer ink contains less than about 5 parts by weight of montan wax or oxidized montan-type wax. On the other hand, if the ink contains greater than about 50 parts by weight of montan wax or oxidized montan-type wax, the blocking resistance is low and therefore the ink is not practical.

The wax melting points were defined by the heat absorption peak resulting from melting the wax using a DSC (differential scanning calorimeter) under the following conditions: Instruments used for measurement:

Thermocontroller SSC-580 and DSC module DSC-20 (Seiko Electronic Industrial Co., Ltd.)

Weight of the sample: 12±1 mg

Temperature range employed for measurement: −20° C. to 180° C.

Heating rate: 10° C./min.

Amount of energy employed: 8000 μJ/sec. (normalized to 1 mg)

Aluminum pan: 35 mg

Gas employed: Nitrogen at a flow rate of 25 ml/min.

The invention will be better understood with reference to the Examples and Comparative Examples. The Examples are presented for purposes of illustration only and are not intended to be construed in a limiting sense.

Figure 1B:
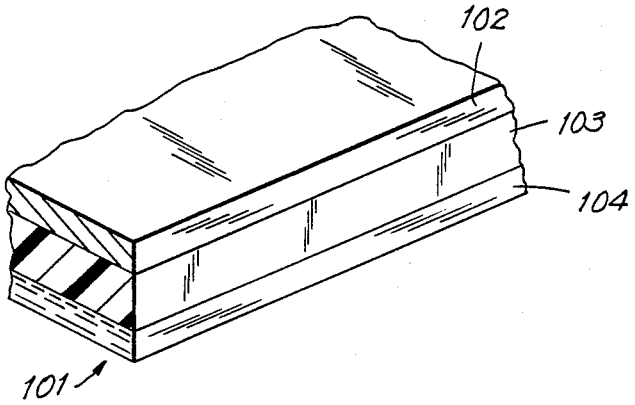
FIG. 1B is a fragmentary enlarged perspective view of a portion of the sheet of FIG. 1A.

Superimposing transfer efficiency and blocking resistance tests were conducted using a rolled sheet of the type designated as 101 in FIG. 1A. As shown in FIG. 1B, ink sheet 101 includes a substrate 103 having an ink layer 104 provided on one side thereof and a resistive layer 102 provided on the opposite side. Resistive layer 102 had the following composition in each Example and Comparative Example:

| | |
|---|---|
| Polyester resin | 79% by weight |
| Conductive carbon black | 20% by weight |
| Carbon black dispersant | 1% by weight |

Substrate 103 was a polyester film and ink layer 104 was a hot-melt ink.

Magenta ink was used as base ink and cyan ink was superimposed on the magenta ink. The magenta ink had the following composition:

| | |
|---|---|
| Carmine 6B | 10% by weight |
| Carnauba wax | 30% by weight |
| Coloring material dispersant | 1% by weight |
| N—Paraffin wax | 50% by weight |
| Ethylene-vinyl acetate copolymer | 9% by weight |

Figure 2:
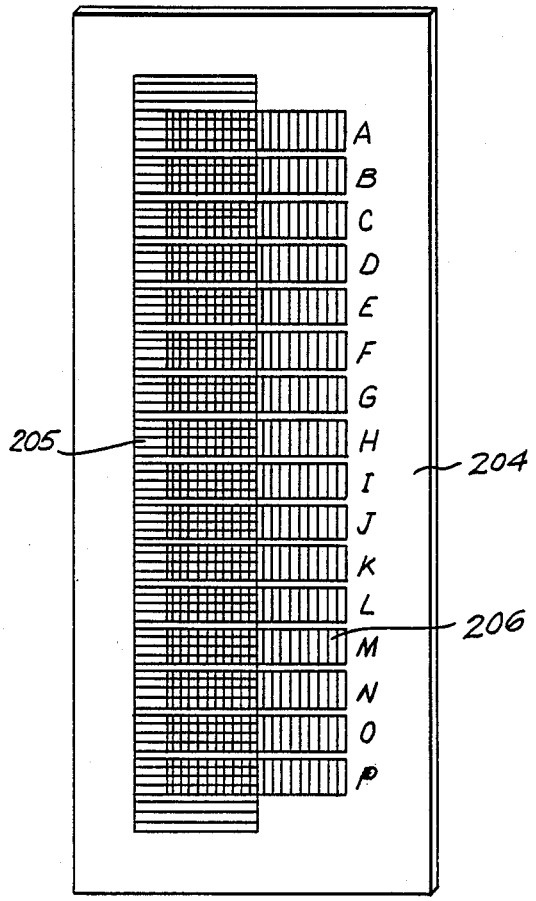
FIG. 2 is a perspective view of a printing pattern used for an ink superimposing test and a chart showing the transfer time used for each test.
Figure 4:
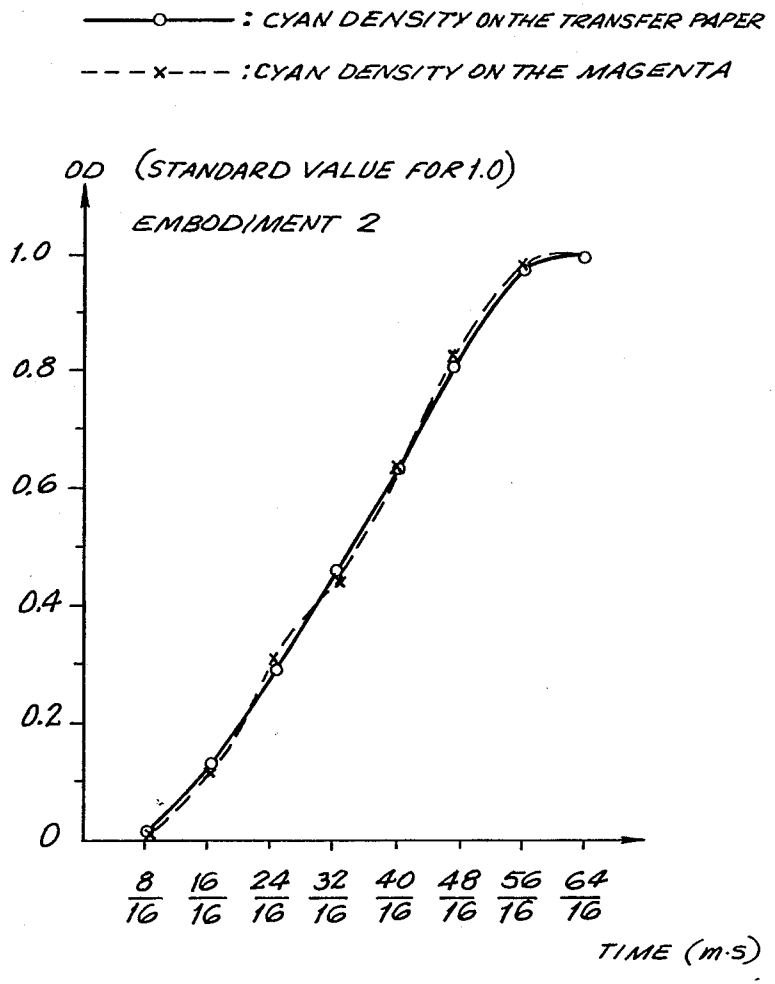
FIGS. 3 to 13 are graphs showing optical density of transferred ink as a function of transfer times for the transfer sheet constructions of Examples 1–7 and Comparative Examples 1–4.
Figure 3:
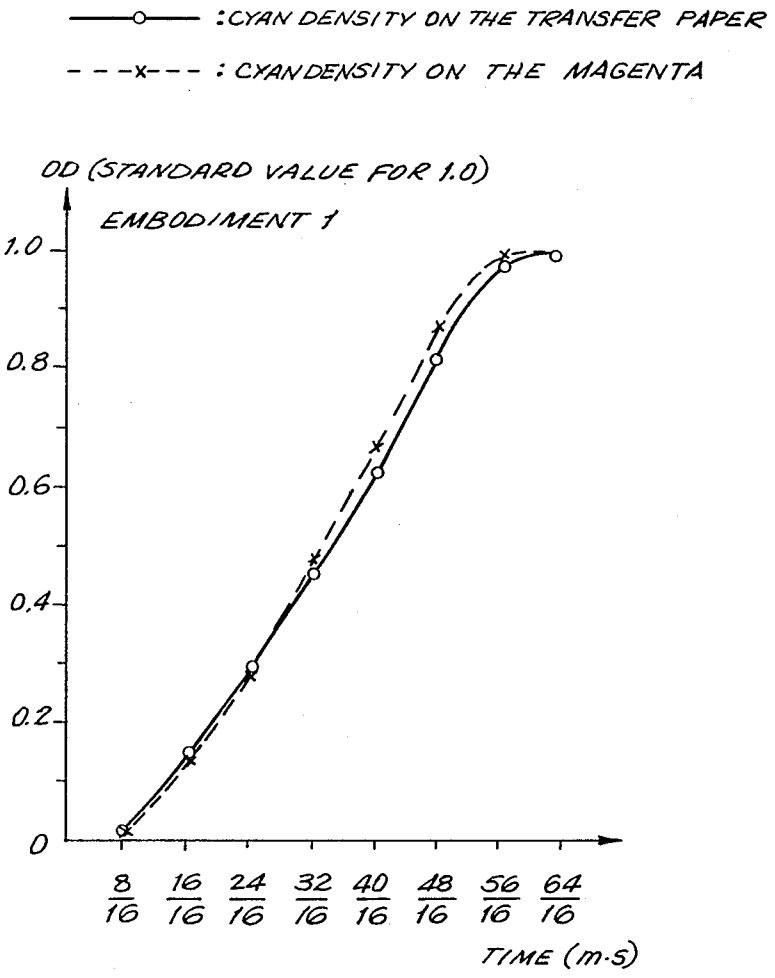
Figure 5:
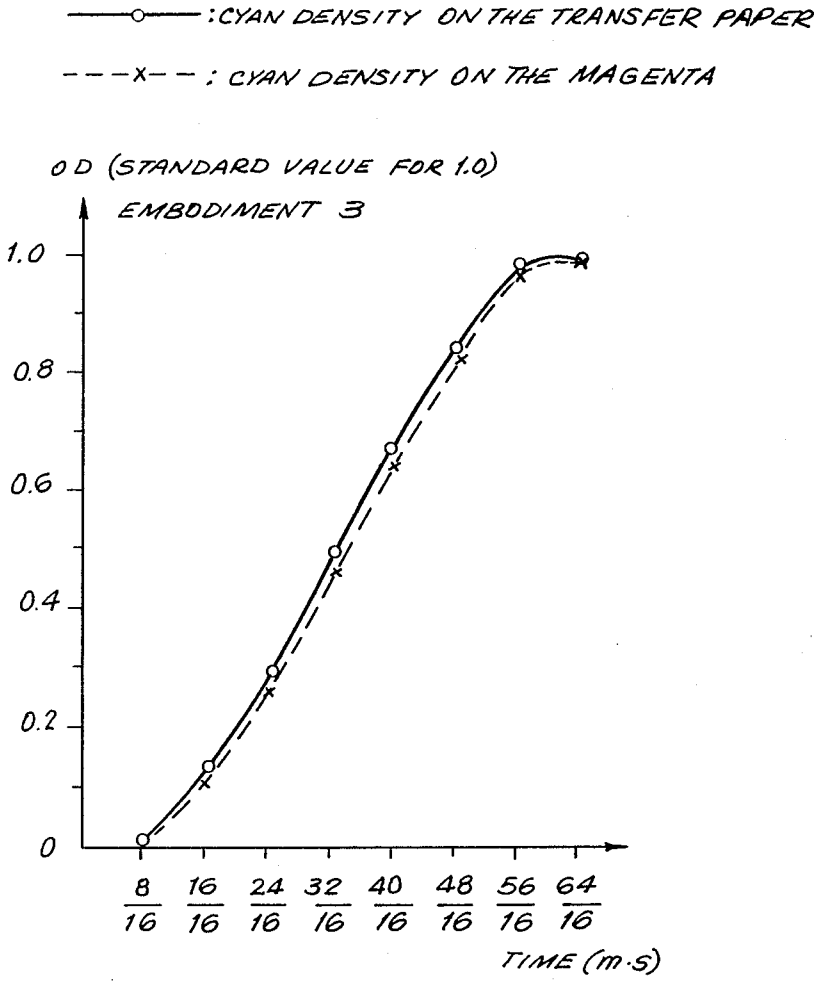
Figure 6:
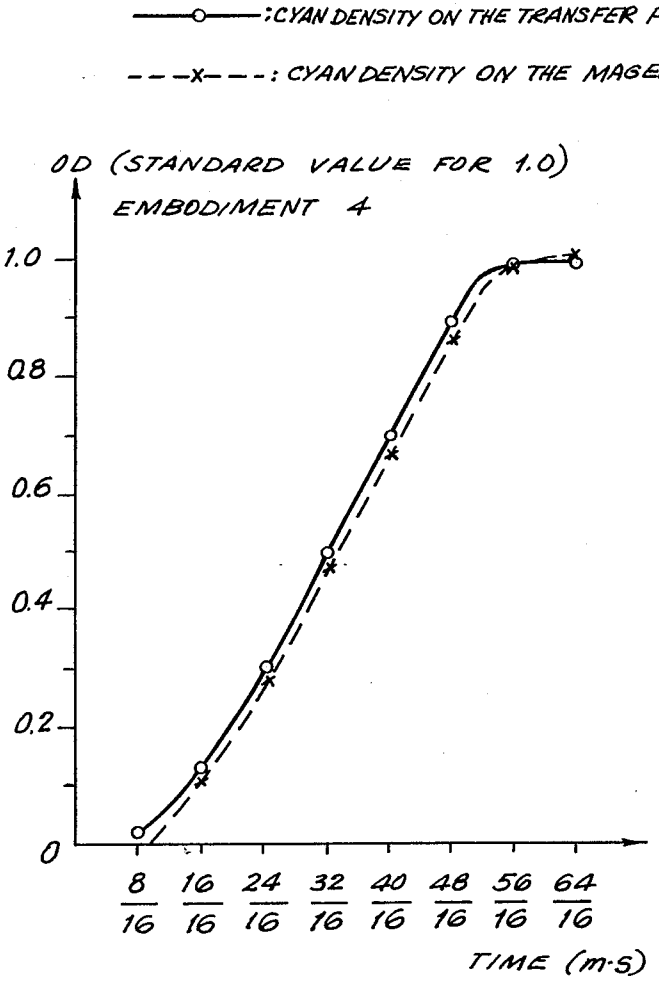
Figure 8:
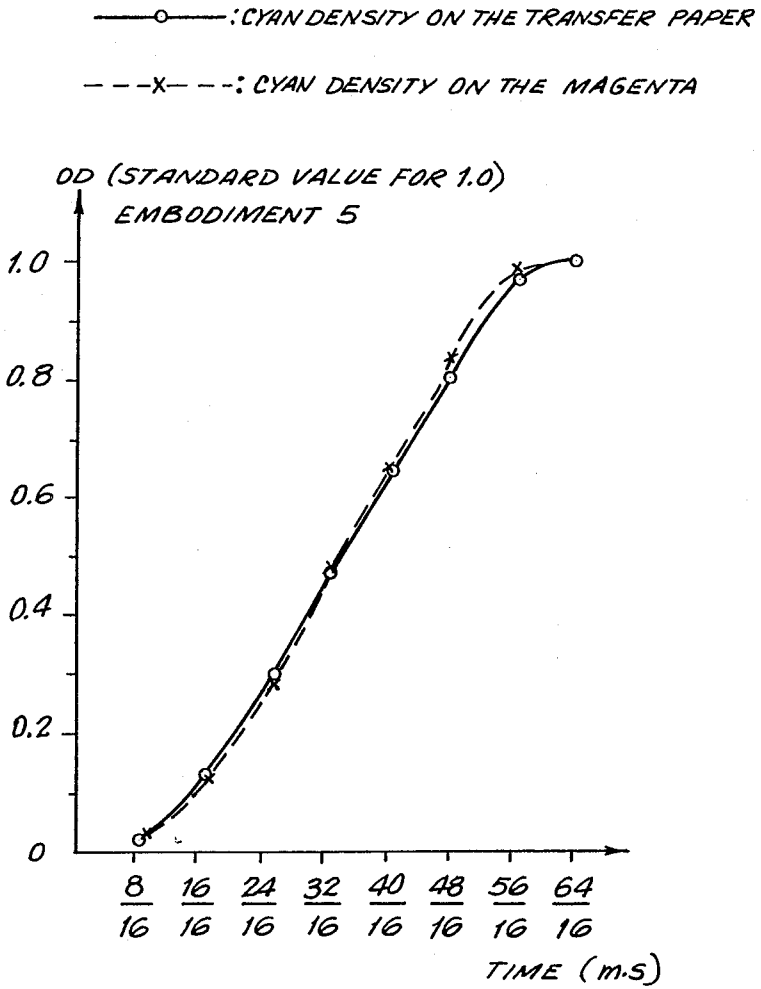
Figure 7:
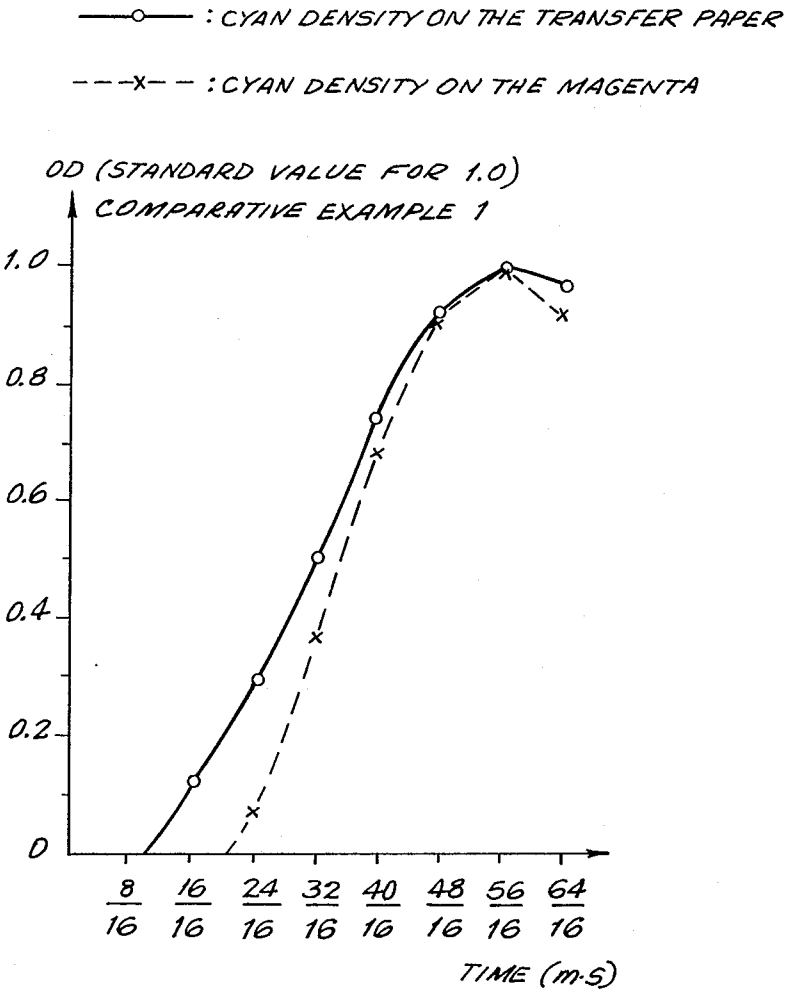
Figure 10:
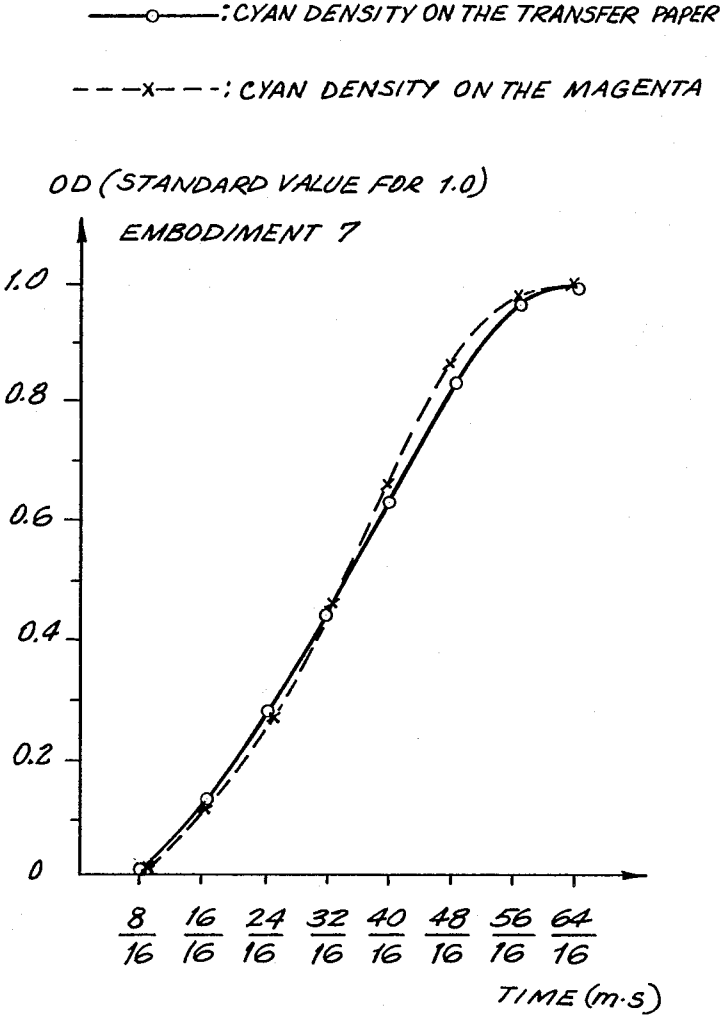
Figure 9:
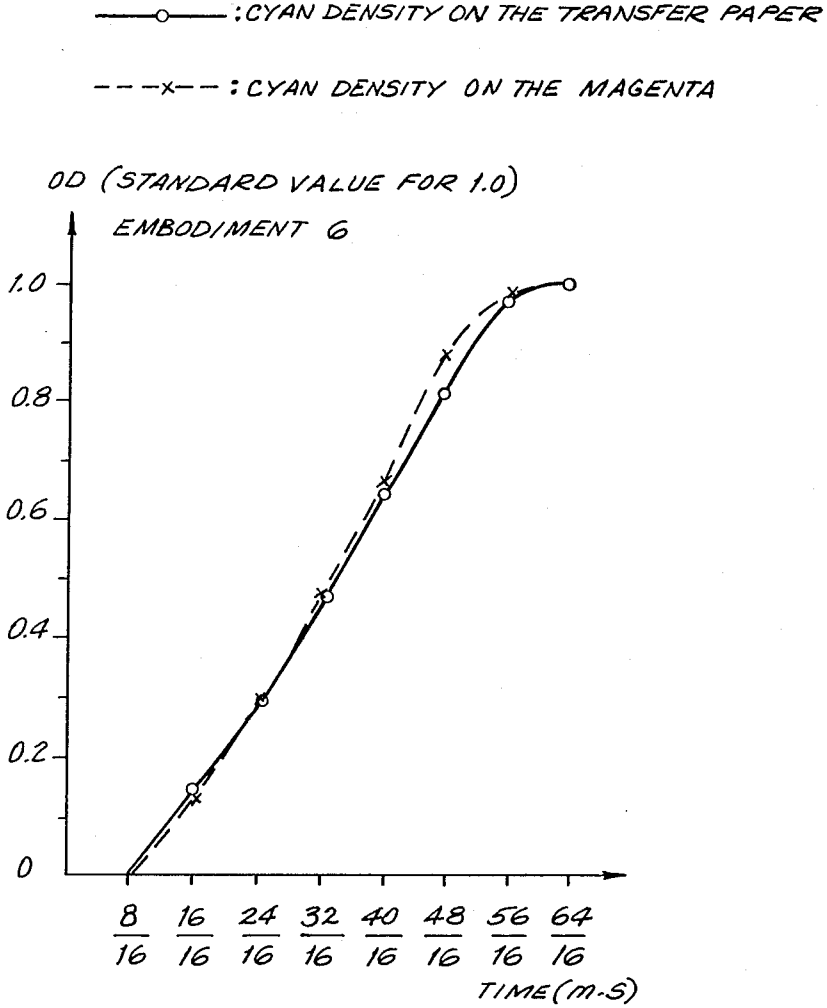
Figure 12:
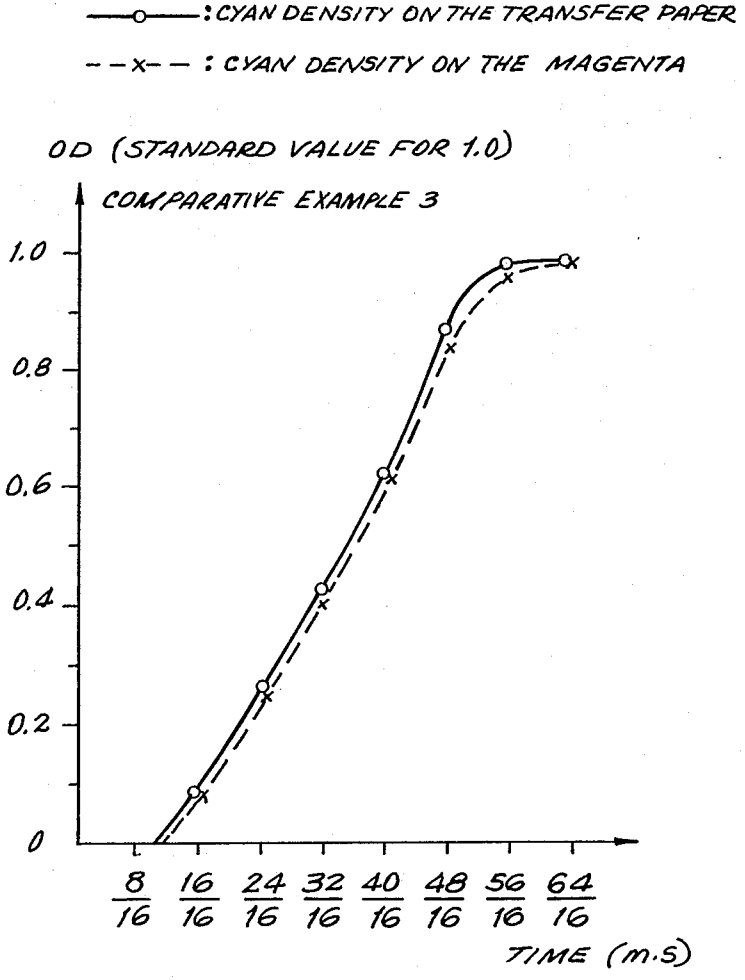
Figure 11:
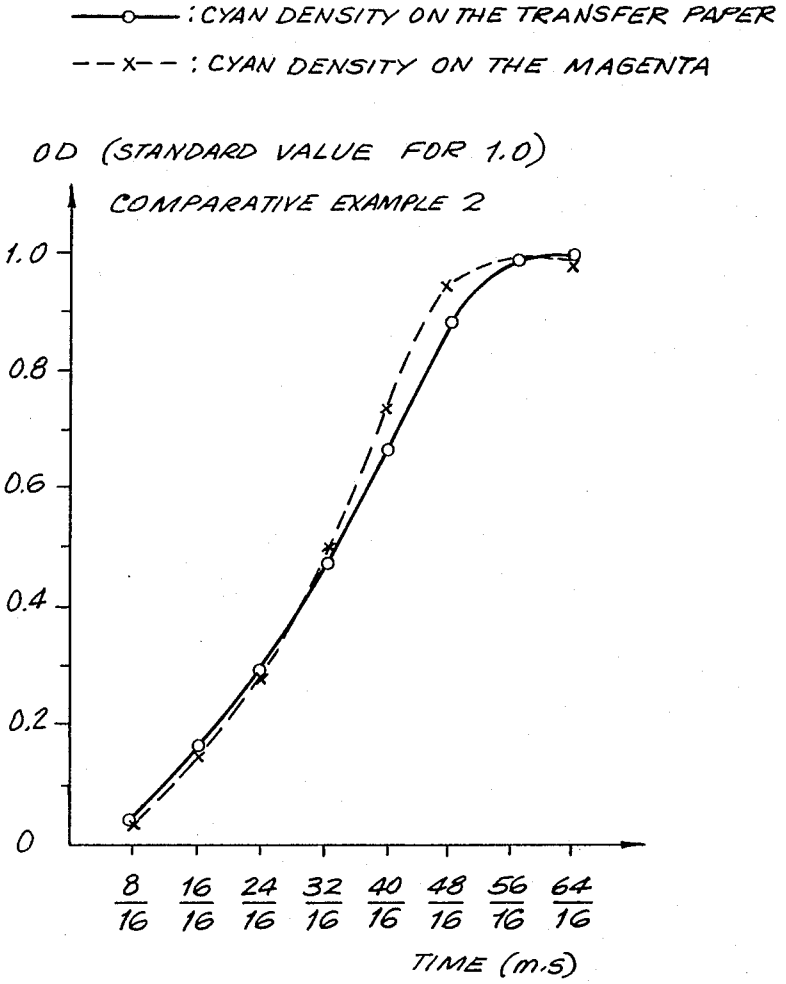
Figure 13:
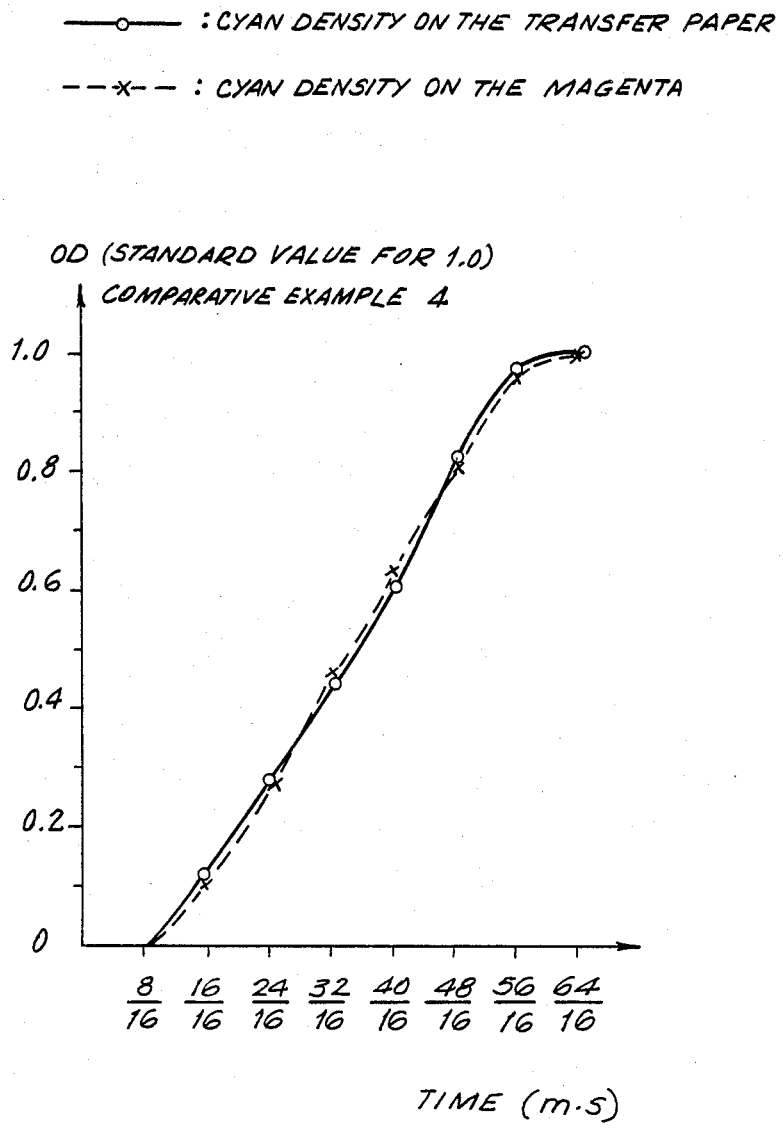

The ink superimposing tests were conducted by transferring a magenta ink 205 onto a sheet of recording paper 204 at full density using a transfer energy of 10 mJ/mm$^2$ for a period of 4 m/sec. A cyan ink 206 was transferred onto magenta ink 205 and onto paper 204 in the pattern shown in FIG. 2. Superimposing transfer efficiency tests were conducted producing a 16-shade area gradation by applying a transfer energy of 10 mJ/mm$^2$ for 16 different periods of time varying between ¼ m/sec to 4 m/sec in increments of ¼ m/sec. The results of the superimposing transfer efficiency tests were obtained by comparing the optical density (OD) of the cyan ink on the magenta ink with the OD of the cyan ink on the paper. Optical density was measured using a Kollomorgan Macbeth TR-927 instrument. The results are shown in FIGS. 3–13 in which the value of 1.0 indicates the maximum OD value in order to facilitate accurate comparison of the results. Paper 204 was TTR paper manufactured by Mitsubishi Paper Co., Ltd.

Blocking resistance tests were conducted by measuring the surface resistivity of the resistive layer on the ink sheet after the roll had been maintained at a temperature of 50° C. for varying predetermined periods of time. All of the ink films had an initial surface resistivity of 2 kΩ/sq, which was raised by the hot-melt ink.

EXAMPLES 1 TO 4 AND COMPARATIVE EXAMPLE 1

The inks of Examples 1 to 4 contain varying amounts of oxidized montan-type wax and the ink of comparative Example 1 does not contain montan wax or oxidized montan-type wax as shown in Table 1.

TABLE 1

| | E-1 | E-2 | E-3 | E-4 | C-1 |
|---|---|---|---|---|---|
| Phthalocyanine Blue | 10 | 10 | 10 | 10 | 10 |
| Carnauba wax | 30 | 30 | 30 | 30 | 30 |
| EVA | 9 | 9 | 9 | 9 | 9 |
| Coloring material dispersant | 1 | 1 | 1 | 1 | 1 |
| N—Paraffin wax | 5 | 20 | 35 | 45 | 50 |

TABLE 1-continued

| | E-1 | E-2 | E-3 | E-4 | C-1 |
|---|---|---|---|---|---|
| Oxidized montan-type wax | 45 | 30 | 15 | 5 | — |

EVA: Ethylene-vinyl acetate copolymer;
Oxidized montan-type wax: Partially saponified ester-modified montan-type wax having a melting point of 80° C.

The results of blocking resistance tests on these inks are shown in Table 2.

TABLE 2

| | Surface resistivity (KΩ/sq.) | | | | |
|---|---|---|---|---|---|
| Elapsed Time | E-1 | E-2 | E-3 | E-4 | C-1 |
| 1 day | 2.0 | 2.0 | 2.0 | 2.0 | 2.0 |
| 5 days | 2.0 | 2.0 | 2.0 | 2.0 | 2.0 |
| 10 days | 2.0 | 2.0 | 2.0 | 2.0 | 2.0 |
| 20 days | 2.0 | 2.0 | 2.0 | 2.0 | 2.0 |
| 30 days | 2.0 | 2.0 | 2.0 | 2.0 | 2.0 |

All of the inks of Examples 1 to 4 and Comparative Example 1 had a high degree of blocking resistance. However, the inks of the invention containing at least 5 parts by weight of an oxidized montan type wax had a greatly improved superimposing transfer efficiency as can be seen from a comparison of FIGS. 3 to 6 corresponding to the results of the transfer efficiency tests on inks of Examples 1 to 4 with FIG. 7 corresponding to the results for the ink of Comparative Example 1.

Examples 5 to 7 and Comparative Examples 2 to 4

The inks of Examples 5 to 7 and Comparative Example 2 contain different types of oxidized montan-type wax. The inks of Comparative Examples 3 and 4 did not contain montan wax or oxidized montan-type wax as shown by the compositions in Table 3.

TABLE 3

| | E-5 | E-6 | E-7 | C-2 | C-3 | C-4 |
|---|---|---|---|---|---|---|
| Phthalocyanine Blue | 10 | 10 | 10 | 10 | 10 | 10 |
| Carnauba wax | 30 | 30 | 30 | 30 | 30 | 30 |
| EVA | 9 | 9 | 9 | 9 | 9 | 9 |
| Coloring material dispersant | 1 | 1 | 1 | 1 | 1 | 1 |
| N—Paraffin wax | 10 | 10 | 10 | 10 | 30 | 40 |
| Oxidized montan-type wax - 1 | 40 | — | — | — | — | — |
| Oxidized montan-type wax - 2 | — | 40 | — | — | — | — |
| Oxidized montan-type wax - 3 | — | — | 40 | — | — | — |
| Oxidized montan-type wax - 4 | — | — | — | 40 | — | — |
| Tackifier | — | — | — | — | 20 | 10 |

Oxidized montan-type wax—1: Partially saponified ester-modified montan-type wax having a melting point of 80° C.;

Oxidized montan-type wax—2: Ester-modified montantype wax having a melting point of 75° C.;

Oxidized montan-type wax—3: Acid-modified montantype wax having a melting point of 73° C.;

Oxidized montan-type wax—4: Ester-modified montantype wax having a melting point of 55° C.;

Tackifier: Rosin type tackifier of Rika Hercules having a melting point of 80° C.

The result of the blocking resistance tests on these inks are shown in Table 4.

TABLE 4

| | Surface resistivity (kΩ/sq.) | | | | | |
|---|---|---|---|---|---|---|
| Elapsed Time | E-5 | E-6 | E-7 | C-2 | C-3 | C-4 |
| 1 day | 2.0 | 2.0 | 2.0 | 2.0 | 2.0 | 2.0 |
| 5 days | 2.0 | 2.0 | 2.0 | 2.5 | 5.0 | 3.5 |
| 10 days | 2.0 | 2.0 | 2.0 | 5.0 | 75 | 55 |
| 20 days | 2.0 | 2.0 | 2.0 | 20 | >100 | >100 |
| 30 days | 2.0 | 2.0 | 2.0 | 80 | >100 | >100 |

The result of the superimposing transfer efficiency tests of Examples 5 to 7 and Comparative Examples 2 to 4 are shown in FIGS. 8 to 13. As can be seen, all of the inks have a high degree of superimposing transfer efficiency.

However, the inks of Comparative Example 2 containing an oxidized montan-type wax having a melting point of less than about 60° C., and Comparative Examples 3 and 4 containing a tackifier, exhibited increased blocking and were unsuitable for practical use. The inks prepared in accordance with the invention showed a higher degree of blocking resistance and maintained their initial surface resistivity of 2.0 kΩ/sq. even after they had been stored at 50° C. for 30 days.

As can be seen, hot-melt inks prepared in accordance with the invention have both a higher degree of superimposing transfer efficiency and a higher degree of blocking resistance. This is accomplished by using the hot-melt ink including a montan wax or an oxidized montan-type wax in an amount between 5 and 50 parts by weight. The montan wax or oxidized montan-type wax should have a melting point between about 60° and 125° C.

It will thus be seen that the objects set forth above among those made apparent from the preceding description are efficiently obtained and, since certain changes may be made in the above composition of matter without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly, it is to be understood that in said claims, ingredients or compounds recited in the singular are intended to include compatible mixtures of such ingredients whenever the sense permits.

What is claimed is:

1. A hot-melt ink for a fusible ink sheet having improved color superimposing performance and blocking resistance, comprising an effective amount of a coloring agent being present in amounts up to about 15% by weight, about 5 and 50% by weight of a wax binder for the hot-melt ink, the wax binder selected from, oxidized montan-type wax and mixtures of montan wax with said oxidized montan-type waxes, the wax binder having a melting point between about 60° and 125° C.

2. The hot-melt ink of claim 1, wherein the wax is oxidized montan-type wax selected from:

(a) acid-modified montan wax having the formula:

$$R-\overset{\overset{\displaystyle O}{\|}}{C}-OH$$

wherein R is an organic group having between about 25 and 35 carbon atoms;

(b) ester-modified montan wax having the formula:

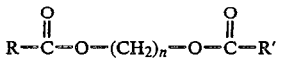

wherein R and R′ are organic groups having between about 25 and 35 carbon atoms and n is an integer greater than or equal to 1; and (c) partially saponified ester-modified montan type wax having the formula:

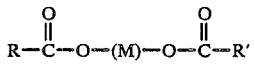

where R and R′ are organic groups having between about 25 and 35 carbon atoms and M is an alkaline earth metal.

3. The hot-melt ink of claim 1, wherein the coloring material is a dye or pigment.

4. The hot-melt ink of claim 1, wherein the hot-melt ink further includes a second wax.

5. The hot-melt ink of claim 4, wherein the second wax is selected from carnauba wax, N-paraffin wax, and mixtures thereof.

6. The hot-melt ink of claim 4, wherein the second wax is present in an amount up to about 50% by weight.

7. The hot-melt ink of claim 1, wherein the hot-melt ink further includes ethylene-vinyl acetate copolymer.

8. The hot-melt ink of claim 7, wherein the ethylene-vinyl acetate copolymer is present in an amount up to about 15% by weight.

9. The hot-melt ink of claim 1, wherein the hot-melt ink further includes an effective amount of a coloring material dispersant for dispersing the coloring material in the ink.

10. The hot-melt ink of claim 1, wherein the hot-melt ink is used as a layer of a fusible ink sheet.

11. The hot-melt ink of claim 10, wherein the fusible ink sheet includes a substrate having the hot-melt ink on one side thereof and an electrothermal resistive layer on the side opposite the ink.

12. The hot-melt ink of claim 11, wherein the substrate is a polyester film.

13. The hot-melt ink of claim 11, wherein the electrothermal resistive layer includes polyester resin, conductive carbon black and a carbon black dispersant.

14. The hot-melt ink of claim 2, wherein the oxidized montan-type wax is synthesized from coal and primarily includes montan wax.

* * * * *